US008107660B2

(12) United States Patent
Inoshita et al.

(10) Patent No.: US 8,107,660 B2
(45) Date of Patent: Jan. 31, 2012

(54) HEARING AID

(75) Inventors: Hiroyoshi Inoshita, Ehime (JP); Yasushi Ueda, Ehime (JP); Yasushi Imamura, Ehime (JP); Junichi Inoshita, Ehime (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/131,326

(22) PCT Filed: Nov. 6, 2009

(86) PCT No.: PCT/JP2009/005932

§ 371 (c)(1),
(2), (4) Date: May 26, 2011

(87) PCT Pub. No.: WO2010/061539

PCT Pub. Date: Jun. 3, 2010

(65) Prior Publication Data

US 2011/0249840 A1 Oct. 13, 2011

(30) Foreign Application Priority Data

Nov. 28, 2008 (JP) ..... 2008-303979

(51) Int. Cl.
*H04R 25/00* (2006.01)

(52) U.S. Cl. ..... 381/328; 381/315

(58) Field of Classification Search ..... 381/312, 381/314, 315, 316, 328, 329
See application file for complete search history.

(56) References Cited

U.S. PATENT DOCUMENTS 4,467,145 A * 8/1984 Borstel ..... 381/329
6,118,878 A * 9/2000 Jones ..... 381/72
7,103,188 B1 * 9/2006 Jones ..... 381/71.9
8,045,727 B2 * 10/2011 Philipp ..... 381/74
2002/0076073 A1 * 6/2002 Taenzer et al. ..... 381/315
2007/0297618 A1 * 12/2007 Nurmi et al. ..... 381/71.6
2007/0297634 A1 * 12/2007 Hansson ..... 381/384
2008/0292126 A1 * 11/2008 Sacha et al. ..... 381/330
2009/0252351 A1 * 10/2009 Rosener ..... 381/151

FOREIGN PATENT DOCUMENTS

JP 8-163700 6/1996
JP 2001-145197 5/2001
JP 2001-145198 5/2001

OTHER PUBLICATIONS

International Search Report of PCT Application No. PCT/JP2009/005932, dated Jan. 26, 2010.

* cited by examiner

*Primary Examiner* — Davetta W Goins
*Assistant Examiner* — Phylesha Dabney
(74) *Attorney, Agent, or Firm* — Panasonice Patent Center; Dhiren Odedra; Kerry Culpepper

(57) ABSTRACT

A hearing aid includes: a sound collection unit configured to collect a surrounding sound; a sound output unit configured to output a sound; and a main body having a shape that can be attached to an ear. The main body includes: a hearing aid processing unit configured to perform hearing aid processing for the surrounding sound collected by the sound collection unit; an attaching determination unit configured to determine whether the main body is attached to the ear based on the surrounding sound; a specific sound generation unit configured to generate a predetermined signal; and a selection unit configured to select one of the sound subjected to the hearing aid processing by the hearing aid processing unit and the sound generated by the specific sound generation unit based on a determination result of the attaching determination unit and to output the selected sound to the sound output unit.

7 Claims, 9 Drawing Sheets

HEARING AID

TECHNICAL FIELD

This invention relates to a technique to prevent an acoustic feedback of a hearing aid.

BACKGROUND ART

Since a hearing aid is attached to an ear, a main body is formed small and a microphone for collecting a surrounding sound of the main body and a speaker for outputting a sound amplified by hearing aid processing are placed at near positions. Thus, an acoustic feedback of outputting an annoying sound from the speaker is likely to occur, which is caused by forming an acoustic loop in which a sound output by the speaker goes around the main body and is again collected in the microphone is formed. Particularly, it easily occurs when a hearing aid is not attached to an ear, because a substance for cutting off the sound going around the main body does not exist.

A hearing aid in which the time from turning on power of a main body to attaching the hearing aid to an ear is preset and a speaker starts to output a sound subjected to hearing aid processing after a lapse of the preset time since the power of the main body has been turned on is disclosed (for example, see Patent Document 1).

RELATED ART DOCUMENTS

Patent Documents

Patent Document 1: JP-A-2001-145197

SUMMARY OF THE INVENTION

Problem to be Solved by the Invention

The technique of preventing output of the sound amplified by hearing aid processing until a lapse of a predetermined time after the power has been turned on contributes to acoustic feedback suppression, but is insufficient from the viewpoint of preventing acoustic feedback when the housing aid is attached. The above-described document discloses that a predetermined time can be changed conforming to the user because the time from turning on the power of the hearing aid to attaching the hearing aid varies depending on the user. However, if the user performs different operation from a usual attaching procedure and it takes time from turning on the power of the hearing aid to attaching the housing aid, a sound amplified by hearing aid processing is output before the hearing aid is attached.

In view of the circumstances described above, an object of the invention is to provide a hearing aid that can prevent output of a sound amplified by hearing aid processing before the user attaches the hearing aid even if it takes time from turning on the power of the hearing aid by the user to attaching the housing aid by the user.

Means for Solving the Problem

To accomplish the object, a hearing aid of the invention includes: a sound collection unit configured to collect a surrounding sound; a sound output unit configured to output a sound; and a main body having a shape attachable to an ear, wherein the main body includes: a hearing aid processing unit configured to perform hearing aid processing for the surrounding sound collected by the sound collection unit; an attaching determination unit configured to determine whether the main body is attached to the ear based on the surrounding sound; a specific sound generation unit configured to generate a predetermined signal; and a selection unit configured to select one of a sound subjected to the hearing aid processing by the hearing aid processing unit and a sound generated by the specific sound generation unit based on a determination result of the attaching determination unit and to output the selected sound to the sound output unit.

Advantages of the Invention

According to the hearing aid of the invention, the sound subjected to the hearing aid processing or the predetermined signal can be selected and output to the sound output unit. The predetermined signal (for example, a sound generated in the hearing aid) is selected and is output to the sound output unit until it is determined that the hearing aid is attached. Thus, the sound subjected to the hearing aid processing is not output before the user attaches the main body of the hearing aid, and consequently it is possible to prevent occurrence of acoustic feedback caused as the sound subjected to the hearing aid processing goes around at the attaching time of the hearing aid, and possible to enhance the user comfort.

MODE FOR CARRYING OUT THE INVENTION

Embodiments of a hearing aid of the invention will be discussed below in detail with accompanying drawings:

Embodiment 1

Figure 1:
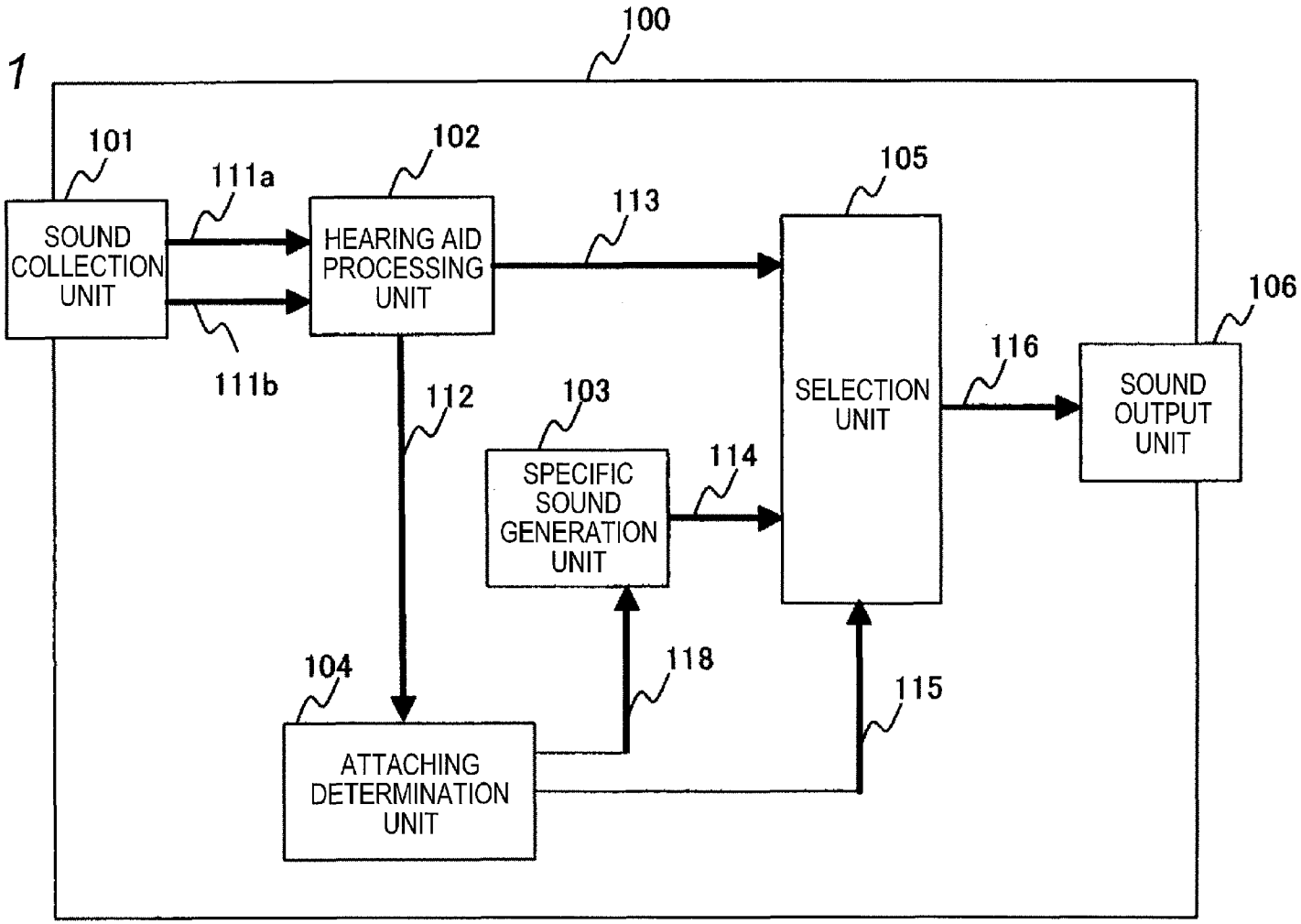
FIG. 1 is a block diagram to show a block configuration of a hearing aid in Embodiment 1 of the invention.

FIG. 1 is a block diagram to show the block configuration of a hearing aid in Embodiment 1 of the invention. As shown in FIG. 1, the hearing aid of the invention includes a sound collection unit 101, a hearing aid processing unit 102, a specific sound generation unit 103, an attaching determination unit 104, a selection unit 105, and a sound output unit 106 in a main body 100.

Although described later in detail, the selection unit 105 selects a predetermined signal (a specific sound, for example, a sound of a single frequency) generated by specific sound generation unit 103 and outputs the signal to the sound output unit 106 until the hearing aid user attaches the main body to an ear after turning on power (not shown) of the main body 100 of the hearing aid. If the attaching determination unit 104 distinguishes the sound of a single frequency output by the sound output unit 106 from among sounds collected by the sound collection unit 101, the attaching determination unit 104 determines that the main body 100 is not attached to an ear.

On the other hand, if the attaching determination unit 104 does not distinguish the sound of a single frequency output by the sound output unit 106 from among the sounds collected by the sound collection unit 101, the attaching determination unit 104 determines that feedback from the sound output unit 106 to the sound collection unit 101 is interrupted, namely, determines that the main body 100 is attached to an ear. The attaching determination unit 104 thus determines that the main body 100 is attached to an ear, the selection unit 105 selects a sound subjected to hearing aid processing by the hearing aid processing unit 102 and outputs the sound to the sound output unit 106 and providing the sound subjected to hearing aid processing is started for the hearing aid user.

The sound collection unit 101 includes a sound opening provided on the main body 100 of the hearing aid and a microphone for collecting a surrounding sound entering the sound opening. The surrounding sound enters the sound opening as an acoustic signal and the microphone converts the acoustic signal into an analog electric signal and outputs the signal to the hearing aid processing unit 102 (collects the surrounding sound). In the embodiment, the sound collection unit 101 is provided with two pairs of sound openings and microphones for providing directivity for the hearing aid user and outputs analog input signals 111*a* and 111*b*.

The hearing aid processing unit 102 performs hearing aid processing for the analog input signals 111*a* and 111*b* output from the sound collection unit 101 and outputs an analog hearing aid signal 113, a signal adjusted so as to suit with the hearing characteristic of the hearing aid user to the selection unit 105. Further, the hearing aid processing unit 102 outputs a power group value 112 described later to the attaching determination unit 104.

Figure 2:
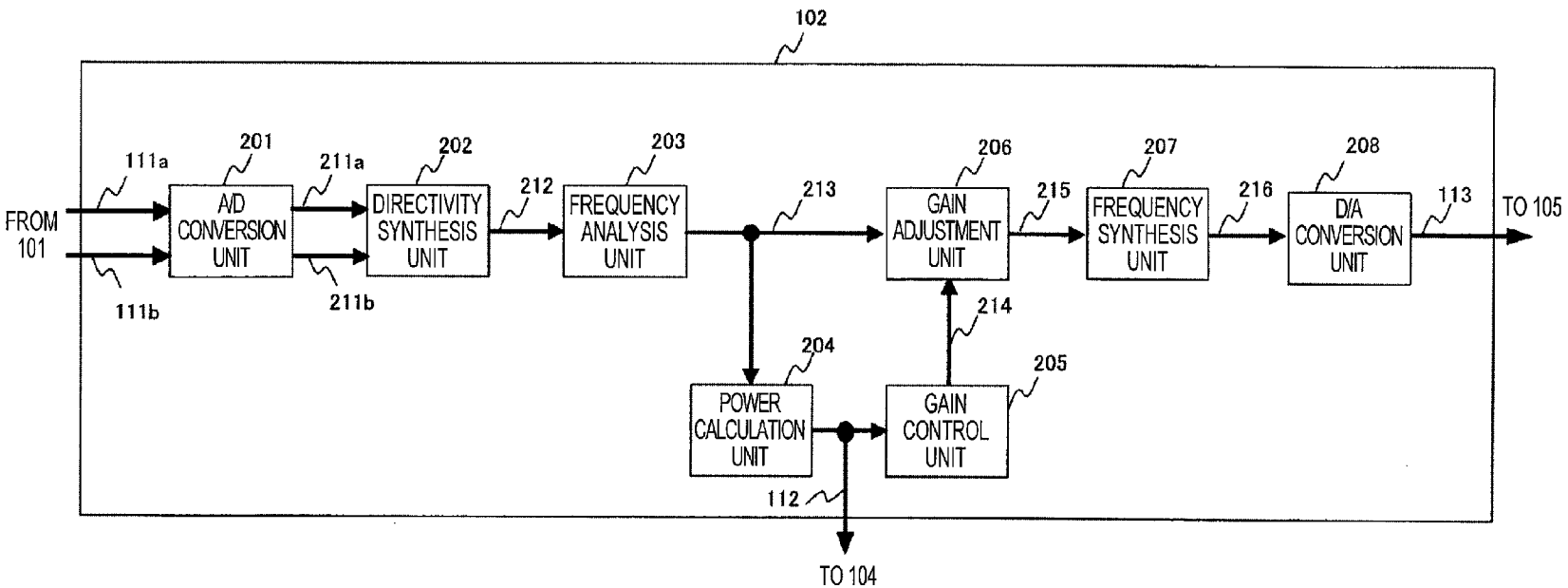
FIG. 2 is a block diagram of a hearing aid processing unit in Embodiment 1 of the invention.

The hearing aid processing unit 102 will be discussed in detail with FIG. 2. As shown in a block diagram of FIG. 2, the hearing aid processing unit 102 includes an A/D (Analog to Digital) conversion unit 201, a directivity synthesis unit 202, a frequency analysis unit 203, a power calculation unit 204, a gain control unit 205, a gain adjustment unit 206, a frequency synthesis unit 207, and a D/A (Digital to Analog) conversion unit 208.

The A/D conversion unit 201 digital-samples the analog input signals 111*a* and 111*b* output from the sound collection unit 101 and outputs them to the directivity synthesis unit 202 as digital input signals 211*a* and 211*b*. In the embodiment, the sampling frequency in the A/D conversion unit 201 is 32 kHz. That is, the analog input signals 111*a* and 111*b* are sampled at 31.25 microsecond intervals and are converted into digital input signals 211*a* and 211*b*.

The directivity synthesis unit 202 enlarges a sound from a specific direction and lessens a sound from any direction other than the specific direction for the hearing aid user. That is, the digital input signals 211*a* and 211*b* are processed and synthesized so that the directivity of the hearing aid is directed to a specific direction. The synthesized signal is output to the frequency analysis unit 203 as a composite signal. The directivity synthesis unit 202 includes a plurality of adaptive filters and an adder, and the computation coefficient is changed, directivity can be directed to any desired direction. Non-directivity in which the user hears sounds in all direction uniformly is also made possible.

The frequency analysis unit 203 converts the synthesized signal 212 input in time series from a signal in a time domain into a signal in a frequency domain, divides the signal into a plurality of frequency bands, and outputs them as a frequency signal group 213. As the method, a system of dividing the Fourier transform result or a subband division system is used. At this time, computation of transform is performed using a plurality of samples of digital-sampled signals by the A/D conversion unit 201. For example, to perform 128-point FFT (Fast Fourier Transform), if one frame is defined as 64 samples, Fourier transform is performed using two continuous frames (2×64=128 samples). Assuming that the frames used for the computation are nth and n+1st frames (n is a natural number), the next Fourier transform is performed for n+1st and n+2nd frames and the Fourier transform result is updated every frame. Since data in each frame is used twice for computation of Fourier transform, the overlap rate becomes 50%.

Division is performed by dividing frequencies between the upper limit and the lower limit of frequencies handled by the hearing aid into a plurality. In the embodiment, sampling is performed at 32 kHz in the A/D conversion unit and thus the frequency band range in which hearing aid processing is effective becomes 0 Hz to 16 kHz according to the sampling theorem. This is divided into equal parts at 250 Hz and 65 frequency signals are output as the frequency signal group 213. Using wavelet transform, the frequency resolution on the low-band frequency side may be made high and the frequency resolution on the high-band frequency side may be made low without dividing all frequency domain into equal parts.

The power calculation unit 204 calculates a power value for each from about the frequency signal of each band of the frequency signal group 213 output from the frequency analysis unit. The power value is power of a signal input to the frequency analysis unit 203 and has correlation with the sound pressure level of an acoustic signal input to the sound collection unit 101. That is, if the sound pressure level is small, the power value becomes small and if the sound pressure level is large, the power value becomes large. The power value is found by calculating sum of squares of a real part and an imaginary part for each frequency signal of each band. The calculated power value of each band is output to the gain control unit 205 as a power value group 112. Further, the power value group 112 is output to the attaching determination unit 104.

The gain control unit 205 determines a gain for the frequency signal of each band based on the power value group 112. A gain table is used to determine the gain. The dynamic range of sense of hearing varies depending on the hearing aid user and nonlinear gain adjustment responsive to the hearing aid user becomes necessary for the sound pressure level of the input acoustic signal. Then, a gain table determining a gain for each input sound pressure level, namely, power value is created based on the gain characteristic necessary for the hearing aid user previously found with an audiogram, etc. The gain control unit 205 includes the gain table about all frequency domain divided by the frequency analysis unit 203. When the power value group 112 is input, the gain control unit 205 references the gain table and determines the corresponding gain. They are output to the gain adjustment unit 206 as a gain control signal group 214.

The gain adjustment unit 206 performs gain computation of the frequency signal group 213 of frequency signals of bands based on the gain control signal group 214 and performs gain adjustment of each frequency signal. The frequency signal subjected to the gain adjustment is output to the frequency synthesis unit 207 as an already adjusted frequency signal group 215.

The frequency synthesis unit 207 converts the already adjusted frequency signal group 215 containing divided 65 frequency signals from a signal in a frequency domain into a signal in a time domain. If frequency analysis is Fourier transform, frequency analysis is performed by inverse Fourier transform; if frequency analysis is subband division, frequency synthesis is performed by subband synthesis. The frequency-synthesized signal is output to the D/A conversion unit 208 as a digital hearing aid signal 216.

The D/A conversion unit 208 executes inverse conversion to that of the A/D conversion unit 201 and converts the digital hearing aid signal 216 of a digital signal into the analog hearing aid signal 113 of an analog signal.

The specific sound generation unit 103 of one of the features of the embodiment generates a predetermined signal (for example, a sound of a single frequency) and outputs the signal as a specific sound signal 114. In the embodiment, the frequency of the sound is 2 kHz. The frequency of the sound may be any if it is less than 16 kHz of a half of a sampling frequency. If the sound pressure level of the specific sound is too large, the user feels annoying; if it is too small, the specific sound becomes hard to distinguish from the surrounding sound and degradation accuracy is degraded. Thus, it is desirable that the level should be set to an intermediate level. In the embodiment, a sound pressure of 62 dBSPL of the magnitude of a normal conversation sound of a human being. Here, dBSPL is an index value indicating the sound pressure. The minimum sound pressure level at which generally a human being can hear is 0 dBSPL, a normal conversation sound is 60 to 70 dBSPL, and 130 dBSPL is an index value at which a large number of people feel annoying.

Generally, the hearing characteristic of the hearing aid user varies from one person to another. Thus, at the time of or after purchase of the hearing aid, work (fitting) of changing setting hardware and software making up the main body 100 of the hearing aid is performed by a fitting device not shown, and optimization of hearing aid processing in the hearing aid processing unit 102 described later is performed. At this time, setting of the frequency and the sound pressure level of the specific sound output from the specific sound generation unit 103 can also be changed conforming to user's liking.

After power of the main body 100 is turned on, if a specific sound generation permission signal output from the attaching determination unit 104 changes from low to high, the specific sound generation unit 103 generates and outputs the specific sound signal 114. When hearing aid processing starts, if the specific sound generation permission signal changes from high to low, the specific sound generation unit 103 stops generating the specific sound. Accordingly, it is mad possible to reduce power consumption in the specific sound generation unit 103 after the hearing aid processing starts.

Figure 3:
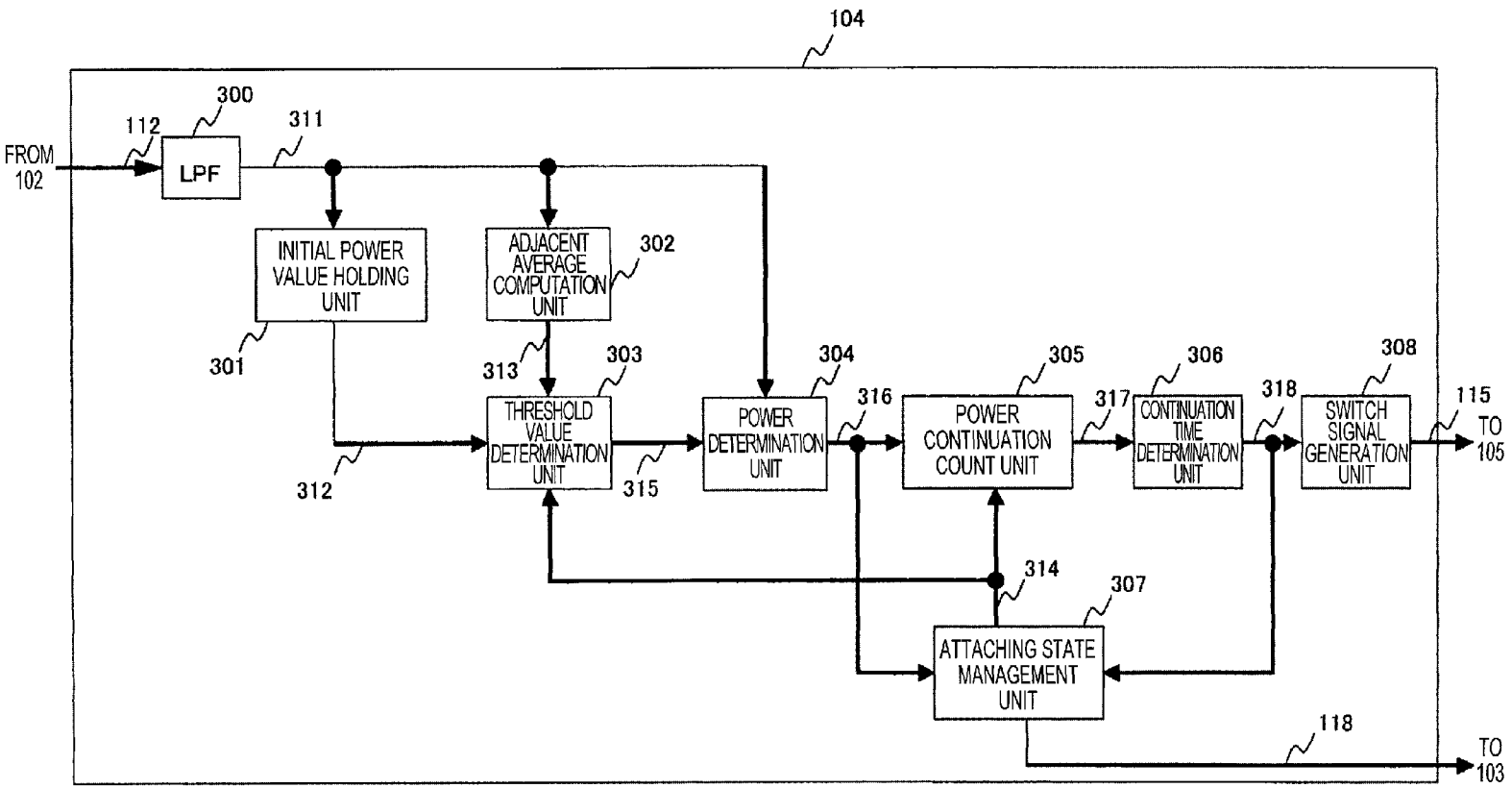
FIG. 3 is a block diagram of an attaching determination unit in Embodiment 1 of the invention.

Next, the attaching determination unit 104 will be discussed in detail with FIG. 3. As shown in a block diagram of FIG. 3, the attaching determination unit 104 includes an LPF (Low Pass Filter) 300, an initial power value holding unit 301, an adjacent average computation unit 302, a threshold value determination unit 303, a power determination unit 304, a power continuation count unit 305, a continuation time determination unit 306, an attaching state management unit 307, and a switch signal generation unit 308.

The power value group 112 output from the hearing aid processing unit 102 is input to the attaching determination unit 104. The LPF 300 executes high-band shut off processing for each power value and outputs a smoothed smooth power value group 311 for each frame. Although the power value group 112 is updated in 2 milliseconds of a frame unit, the time required for the user to attach the hearing aid is on the second time scale, and if change in the power value in units of several tens to several hundreds of milliseconds is obtained, detection of the attaching operation is made possible. The LPF 300 performs high-band shut off processing in a time axis direction for the power value group 112 input at 2-millisecond intervals, thereby lessening the effect of external noise unnecessary for detection of the attaching operation.

The initial power value holding unit 301 takes out and holds the power value of a frequency band containing a frequency of 2 kHz from the smooth power value group 311 in one frame just after the whole circuit of the hearing aid starts up and becomes a stationary state after power of the main body 100 of the hearing aid is turned on and is started. At this time, a sound is not yet output from the sound output unit 106 although described later. In the embodiment, the range of the frequency band from 0 Hz to 16 kHz in which the hearing aid processing is effective is divided in steps of 250 Hz and thus the power value in the frequency band from 2 kHz to 2.25 kHz is held. The held power value is output to the threshold value determination unit 303 as an initial power value 312.

The adjacent average computation unit 302 finds, for each frame, an average value of power values in frequency bands adjacent to the frequency band of the sound generated by the specific sound generation unit 103 from the smooth power value group 311. This is performed to measure noise (surrounding sound) occurring in the vicinity of the frequency other than the sound generated by the specific sound generation unit 103. In the embodiment, an average value of power values in three frequency bands from 2 kHz to 2.25 kHz and from 1.75 kHz to 2 kHz and from 2.25 kHz to 2.5 kHz adjacent to that frequency band is found and is output to the threshold value determination unit 303 as an adjacent power average value 313. Computation of the adjacent power average value 313 is performed at the same timing as the above-described processing of the initial power value holding unit 301. Thus, the adjacent power average value 313 does not contain power of the sound generated by the specific sound generation unit 103.

The threshold value determination unit 303 determines a threshold value from the initial power value 312 output from the initial power value holding unit 301 for each frame, the magnitude of the adjacent power average value 313 found by the adjacent average computation unit 302, and an attaching state signal 314 output from the attaching state management unit 307 and outputs the threshold value to the power determination unit 304 as a power threshold value 315. The threshold value is used to compare with the input power value in the power determination unit 304 for determining whether or not the hearing aid is attached to an ear of the user. A determination method of the power threshold value 315 described later in detail.

The power determination unit 304 makes a comparison between the power threshold value 315 and the power value in the frequency band from 2 kHz to 2.25 kHz contained in the smooth power value group 311 and outputs the comparison result to the power continuation count unit 305 and the attaching state management unit 307. When the power value in the frequency band from 2 kHz to 2.25 kHz is equal to or greater than the power threshold value 315, a threshold value comparison signal 316 goes low; when the power value in the frequency band from 2 kHz to 2.25 kHz is smaller than the power threshold value 315, the threshold value comparison signal 316 goes high.

The power continuation count unit 305 is a counter incremented by one in one frame and outputs a counter value 317 to the continuation time determination unit 306. The power continuation count unit 305 operates only when the state indicated by the attaching state signal 314 is a specific state. While the threshold value comparison signal 316 is low, the power continuation count unit 305 is reset to 0. When the threshold value comparison signal 316 switches from low to high, the power continuation count unit 305 starts to count.

The continuation time determination unit 306 compares the counter value 17 with a predetermined value (an arbitrary value preset in storage means (not shown) provided in the continuation time determination unit 306; hereinafter the value will be referred to as "attaching stable wait time"), and outputs a switch trigger signal 318 for prompting a signal selected by the selection unit 105 to be switched from the specific sound signal 114 to the analog hearing aid signal 113 to the switch signal generation unit 308 and the attaching state management unit 307. The initial value of the switch trigger signal 318 is low and when the counter value 317 becomes equal to or greater than the attaching stable wait time, the switch trigger signal 318 switches to high. The attaching stable wait time specifies the elapsed time since the threshold value comparison signal 316 changed from low to high, namely, the elapsed time since the main body 100 of the hearing aid wore in an ear, the sound generated by the specific sound generation unit 103 was not collected in the sound collection unit 101, and the power value in the frequency band from 2 kHz to 2.25 kHz became smaller than the power threshold value 315. For example, to output a sound subjected to hearing aid processing in about one second after the hearing aid is attached to an ear, in the embodiment, the frame period is 2 milliseconds and thus the attaching stable wait time becomes 500 from a calculation expression of $1 \div 0.002 = 500$.

The hearing aid user often attaches the hearing aid while finding out a just fit position by twisting the main body 100 of the hearing aid while inserting it into an ear. In this case, after the main body 100 of the hearing aid and the ear come in intimate contact with each other and going around of the sound generated by the specific sound generation unit 103 is interrupted, there is a possibility that again a gap may occur between the main body 100 of the hearing aid and the ear to adjust the position of the main body 100 of the hearing aid and going around of sound may occur.

Thus, the attaching stable wait time compared with the counter value 317 is lessened and if the selection unit 105 selects the analog hearing aid signal 113 immediately when the sound collection unit 101 does not collect the sound generated by the specific sound generation unit 103, it is feared that acoustic feedback may occur when a gap occurs between the main body 100 of the hearing aid and the ear to adjust the position of the main body 100 of the hearing aid.

Then, considering the operation at the hearing aid attaching time, the attaching stable wait time is set in the continuation time determination unit 306. For example, when a new hearing aid is purchased or a hearing aid is made over, assuming that shifting operation little by little occurs long to finely adjust the position of the main body 100 of the hearing aid since the main body 100 of the hearing aid was inserted into an ear, the attaching stable wait time in the continuation time determination unit 306 is set to 2500 from an expression of $5 \div 0.002$ so that a sound subjected to hearing aid processing is output in about 5 seconds. The attaching stable wait time can be changed from the fitting device, etc., and can be adjusted in response to the skill level of the hearing aid user.

Figure 4:
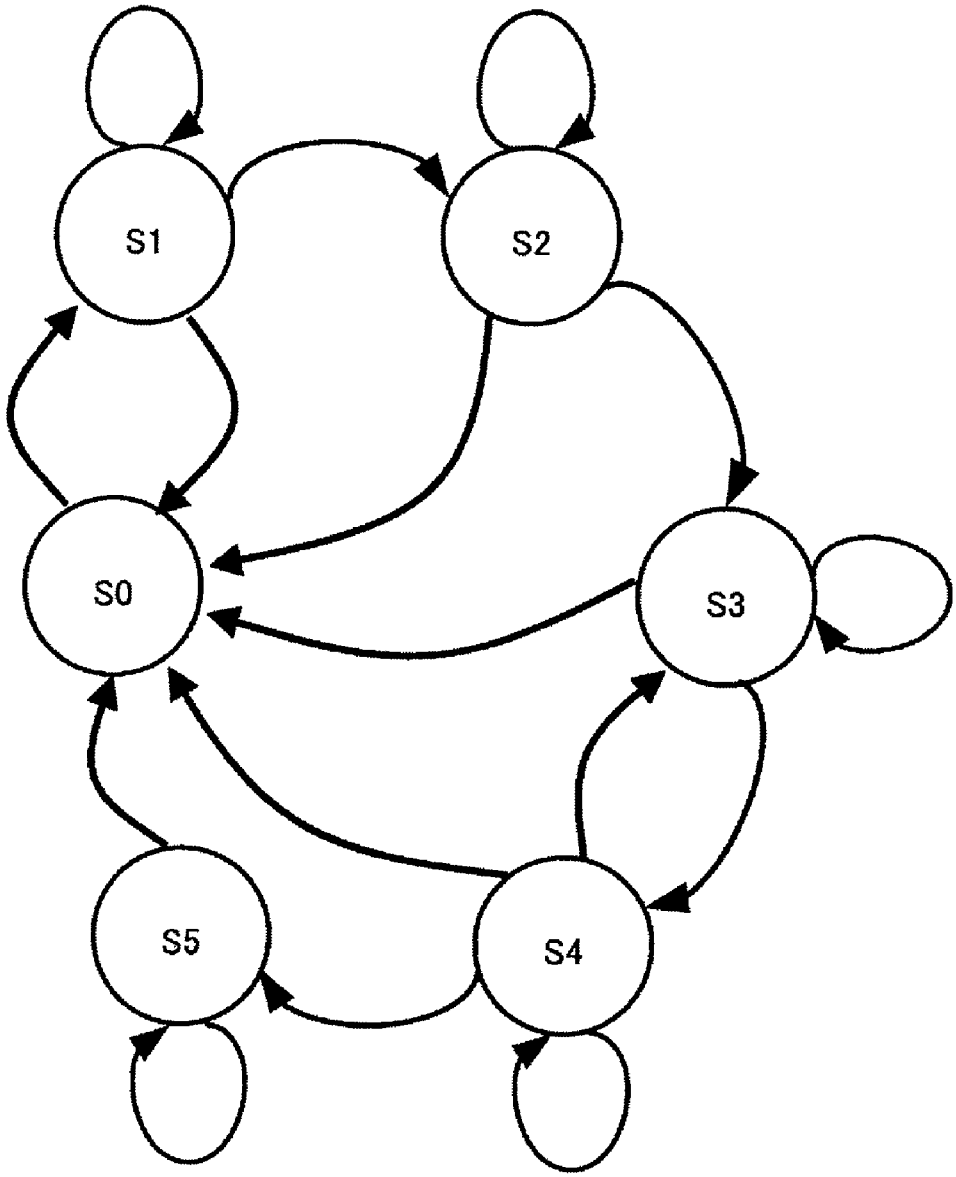
FIG. 4 is a state transition diagram of managing the operation of the attaching determination unit in Embodiment 1 of the invention.

The attaching state management unit 307 manages each state at the hearing aid attaching time shown from S0 to S5 shown in FIG. 4 and outputs an attaching state signal 314 and a specific sound generation permission signal 118 changing in response to each state. S0 is an initial state, S1 is a surrounding sound determination state, S2 is an attaching start state, S3 is a state just before attachment, S4 is a stable wait state after completion of attachment, and S5 is a hearing aid processing operation state.

Corresponding to the states of S0 to S5, the attaching state signal 314 becomes 0 when the state is S0; 1 when the state is S1; 2 when the state is S2; 3 when the state is 3; 4 when the state is 4; and 5 when the state is 5, and the specific sound generation permission signal 118 goes low when the state is S0, S1, or S5; the signal goes high when the state is S2, S3, or S4.

FIG. 4 shows state transition in the attaching state management unit 307. From the state of S1 to S5, when power is tuned on or is reset, the state is reset to S0 and the state transition shown in FIG. 4 is made until the hearing aid processing operation starts. The state-to-state transition is described later in detail.

The switch signal generation unit 308 outputs a switch signal 115 for the selection unit 105 to select either the analog hearing aid signal 113 or the specific sound signal 114. When power of the main body 100 of the hearing aid is turned on, the switch signal generation unit 308 makes the switch signal 115 high. When the switch trigger signal 318 switches from low to high, the switch signal generation unit 308 changes the switch signal 115 from high to low. When the switch signal generation unit 308 changes the switch signal 115 from high to low, it holds the switch signal 115 low until the power of the main boy 100 of the hearing aid is later turned off.

When the switch signal 115 output by the attaching determination unit 104 is low, the selection unit 105 selects the analog hearing aid signal 113 output by the hearing aid processing unit 102; when the switch signal 115 is high, the selection unit 105 selects the specific sound signal 114 output by the specific sound generation unit 103 and outputs the selected signal to the sound output unit 106 as a selection output signal 116.

That is, while the attaching determination unit 104 determines that the sound collection unit 101 collects the sound generated by the specific sound generation unit 103, the sound generated by the specific sound generation unit 103 is selected and is output to the sound output unit 106. When the attaching determination unit 104 determines that the sound collection unit 101 does not collect the sound generated by the specific sound generation unit 103, the sound subjected to hearing aid processing by the hearing aid processing unit 102 is selected and is output to the sound output unit 106.

The sound output unit 106 includes a sound introduction opening and a speaker. The speaker converts the selection output signal 116 output by the selection unit 105 into an acoustic signal and outputs the signal. If the hearing aid is an in-the-ear hearing aid, the sound introduction opening is a hole provided so that the acoustic signal output by the speaker is introduced to the outside of the main body of the hearing aid. If the hearing aid is a behind-the-ear hearing aid, the sound introduction opening is a hole connecting to a sound introduction passage provided in a tube for introducing the sound output by the hearing aid into the ear of the hearing aid user.

Next, the operation when the hearing aid of the embodiment is attached to an ear will be discussed with FIG. 5. FIG.

5 shows an ear and a cross section in the vicinity of an ear canal of the hearing aid user and the main body 100 of the hearing aid to describe the positional relationship between the main body 100 and the ear when the hearing aid is attached and going around of a sound. In FIG. 5, numeral 500 denotes the ear of the hearing aid user, numeral 501 denotes a state of a sound output from the sound output unit 106 of the main body 100 and going around to the sound collection unit 101, and numeral 502 denotes a state in which the sound output from the sound output unit 106 of the main body is reflected on the ear 500 and goes around in the direction of the sound collection unit 101.

Figure 5A:
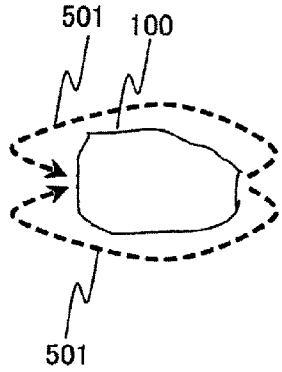
FIG. 5 is a drawing to show a cross section of an ear and the vicinity of an ear canal of the user of the hearing aid and a main body of the hearing aid in Embodiment 1 of the invention.
Figure 5B:
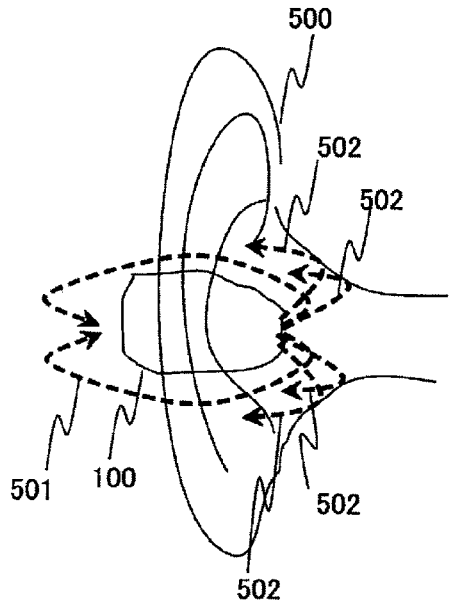
Figure 5C:
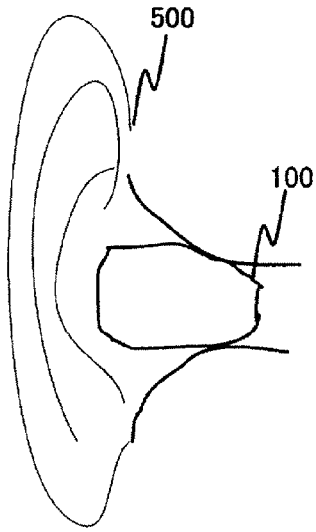
Figure 6A:
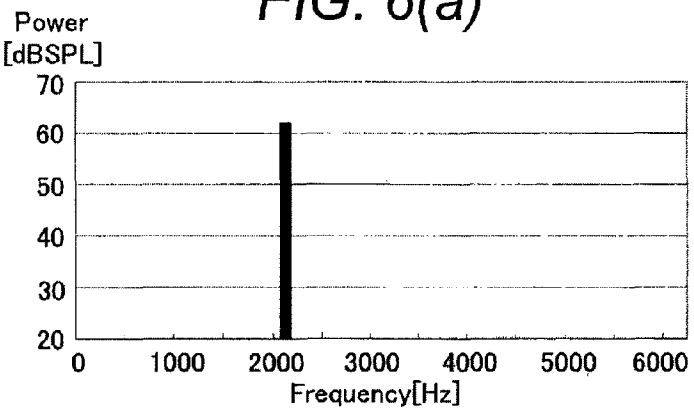
FIG. 6 is a drawing to show sound output from the main body of the hearing aid in Embodiment 1 of the invention and a result of frequency analysis of the sound again input to the main body of the hearing aid.
Figure 6B:
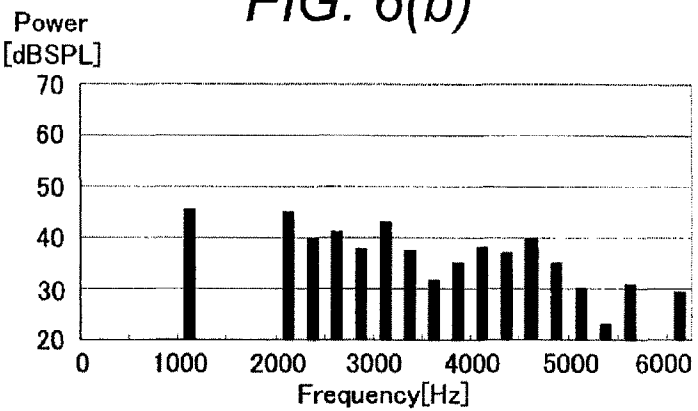
Figure 6C:
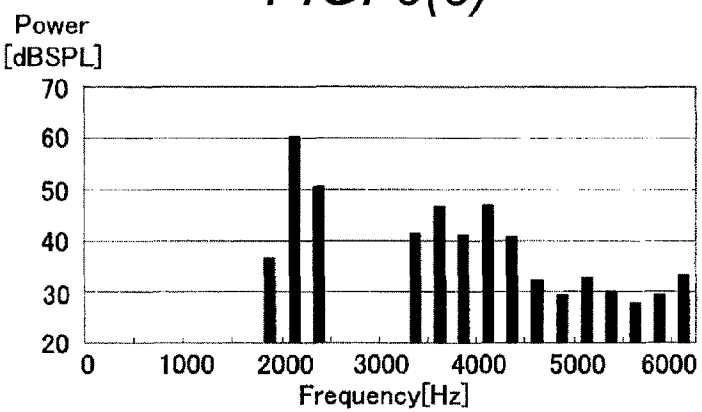
Figure 6D:
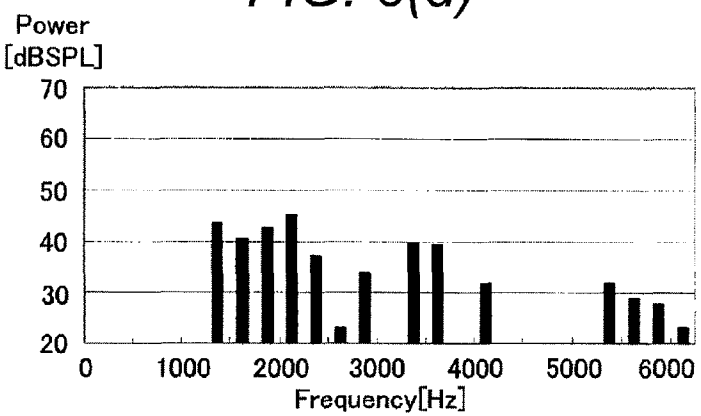

To begin with, to start use of the hearing aid, when the power of the main body 100 is turned on, the switch signal 115 output from the attaching determination unit 104 in FIG. 1 is set to high as described above, a sound generated by the specific sound generation unit 103 is output from the sound output unit 106, and the sound 501 which goes around shown in FIG. 5(*a*) is collected by the sound collection unit 101. The attaching determination unit 104 determines that the sound collected by the sound collection unit 101 is a sound generated by the specific sound generation unit 103, continues the switch signal high, and outputs the sound generated by the specific sound generation unit 103 from the sound output unit 106.

Next, as shown in FIG. 5 (*b*), when the main body 100 is brought close to the ear 500, the sound output by the sound output unit is reflected on the ear 500, whereby a reflection sound occurs and the volume of the sound collected by the sound collection unit 101 becomes large. The attaching determination unit 104 determines that the sound generated by the specific sound generation unit 103 is collected, and the sound output unit 106 continuously outputs the sound generated by the specific sound generation unit 103.

Next, as shown in FIG. 5(*c*), when the main body 100 is completely attached to the ear canal of the ear 500, the main body 100 and the ear canal of the ear 500 come in intimate contact with each other, whereby the acoustic loop is blocked. Then, the sound collection unit 104 does not collect the sound output by the sound output unit 106 and thus the attaching determination unit 104 determines an attaching state and switches the switch signal to low. Accordingly, the sound provided by performing hearing aid processing for the sound collected by the sound collection unit 101 is output from the sound output unit 106 and the hearing aid functions.

Next, to describe the detailed operation of the attaching determination unit 104 when the hearing aid of Embodiment 1 is attached to an ear, the contents shown in FIGS. 6 and 7 will be discussed.

FIG. 6 shows a graph with frequency on the horizontal axis and sound pressure level (power) [dBSPL]. FIG. 6(*a*) shows the sound pressure level when the specific sound signal 114 is output as a sound from the sound output unit 106 via the selection unit 105. FIGS. 6(*b*), 6(*c*), and 6(*d*) show a smooth power value group 311 of the sound collected by the sound collection unit 101 when the specific sound signal 114 is output from the sound output unit 106 via the selection unit 105. FIGS. 6(*b*), 6(*c*), and 6(*d*) show measurement examples in the following conditions of the hearing aid attaching operation:

FIG. 6(*b*) is state 1 in which after the power of the main body 100 of the hearing aid is tuned on in a room in a comparatively silent environment, the user holds the main body 100 with a hand and brings the main body 100 close to an ear at a distance of 10 cm. FIG. 6(*c*) is state 2 in which a part of the main body enters an ear hole. FIG. 6(*d*) is a state 3 in which the main body 100 completely enters the ear hole.

Figure 7:
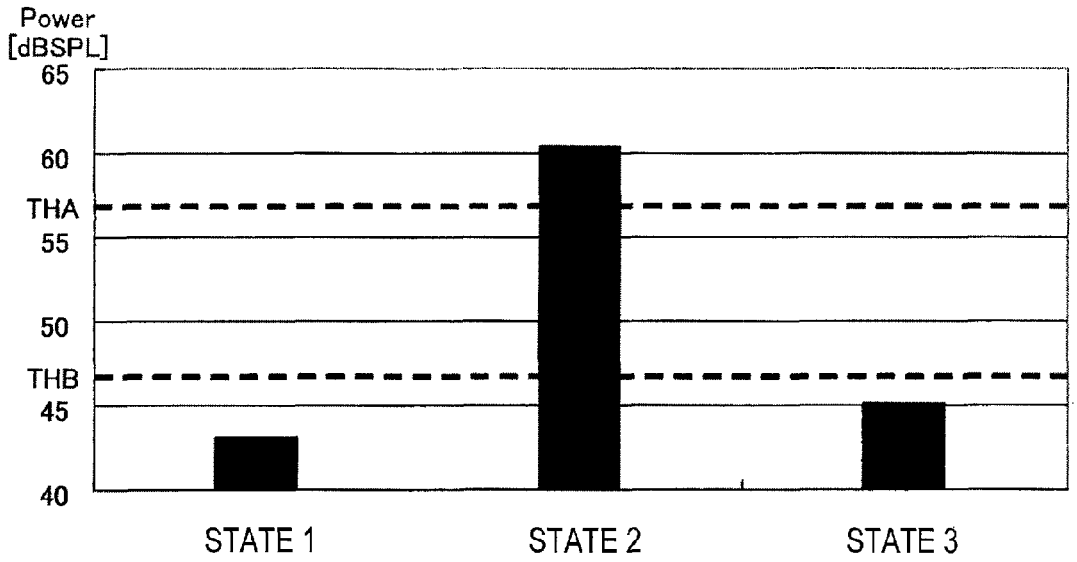
FIG. 7 is a drawing to show change in the signal level concerning a specific frequency of the signal in FIG. 6.

FIG. 7 extracts a power value of frequency bands of 2 kHz to 2.25 kHz from the smooth power value group 311 shown in FIGS. 6(*b*), 6(*c*), and 6(*d*).

Subsequently, the detailed operation of the attaching determination unit 104 will be discussed with FIGS. 4, 6, and 7. From here, description is given along the transition of states S0 to S5 in the attaching state management unit 307. In the embodiment, the case where when the user attaches the main body 100, the user exists in a silent environment in which the surrounding sound is comparatively small will be discussed.

[S0: Initial State]

When the power of the main body 100 is turned on, the attaching state management unit 307 becomes state 0 shown in FIG. 4. At this time, the blocks of the attaching determination unit 104 (see FIG. 3) are also initialized. For example, means (not shown) for holding a status flag indicating either 0 or 1 is provided in the threshold value determination unit 303 and in state S0, the flag is set to 0. That is, when the attaching state signal 314 is 0, initialization is executed. When the whole circuit of the hearing aid starts up and becomes a stationary state, the attaching state management unit 307 makes a transition to state S1. The transition from state 0 to state 1 may be managed based on the elapsed time or may be managed based on information of startup of any other block. For example, if the transition is managed based on the elapsed time, the startup time of the block whose startup is the latest after the power is turned on is preset and when the time has elapsed, a transition to S1 is made. Alternatively, a signal is connected from the block whose startup is the latest after the power is turned on is to the attaching state management unit 307 and when startup of the block is identified by the signal, a transition to S1 is made.

[S1: Surrounding Sound Determination State]

In the attaching state management unit 307, when a transition to S1 is made, the attaching state signal 314 is set to 1. Then, the threshold value determination unit 303 determines a threshold value from the initial power value 312 and the adjacent power average value 313 and outputs it as the power threshold value 315. Specifically, if the adjacent power average value 313 is smaller than the initial power value 312, the threshold value is set to a value larger than the initial power value 312 and smaller than the sound pressure level of a specific sound. At this time, the status flag in the threshold determination unit 303 holds 0. In the embodiment, from the above-mentioned condition, the level is set to a level of 57 dBSPL of a value larger than 45 dBSP and smaller than 62 dBSPL (see FIG. 7) and hereinafter the threshold value determined in state S1 will be represented as THA.

THA is the threshold value for determining a state in which the main body 100 is brought close to the ear 500 and the volume of the sound collected by the sound collection unit 101 becomes large because of the effect of reflection sound 502 (FIG. 5(*b*)). Thus, if THA is set in a direction in which it becomes small in the range in which THA is larger than the initial power value 312 and is smaller than the sound pressure level of the specific sound, the effect of the surrounding sound is easily received and thus the occurrence probability of erroneous determination becomes high. On the other hand, if THA is set in a direction in which it becomes large, the effect of the surrounding sound becomes hard to receive. However, the magnitude of the reflection sound 502 varies depending on the shape of a pinna whose personal equation is large and the positional relationship between the main body 100 of the hearing aid and the ear 500 at the attaching time and thus a possibility that it will become impossible to determine that the main body 100 is brought close to the ear 500 occurs.

Thus, from a tradeoff between the merit and the demerit when THA is changed, it is desirable that THA should become comparatively large within the range in which THA can be set. In Embodiment 1, THA is set to 57 dBSPL smaller than 62 dBSPL of the sound pressure level of the specific sound by 5 dB as an explanatory example. The value of THA set in state S1 can be adjusted to the most suitable value to the user from the fitting device, etc.

On the other hand, if the adjacent power average value 313 is equal to or greater than the initial power value 312, THA is set to the level of the adjacent power average value 313 and the status flag in the threshold determination unit 303 is changed to 1. When setting of THA is complete, a transition to state S2 is made. When a transition to state S2 is made, the threshold determination unit 303 holds THA until the state next becomes S0.

[S2: Attaching Start State]

The power determination unit 304 makes a comparison between the power threshold value 315 where THA is output and the power value in the frequency band from 2 kHz to 2.25 kHz for each frame, and outputs a threshold value comparison signal 316. Consequently, if the threshold value comparison signal 316 is high, the attaching state management unit 307 continues the state of S2 and when the threshold value comparison signal 316 goes low, a transition to state S3 is made.

The threshold determination unit 303 changes the power threshold value 315 at the timing at which a transition to state S3 is made. Specifically, when the attaching state signal 314 changes from 2 to 3, if the status flag in the threshold determination unit 303 is 0, the threshold value is set to a range larger than the initial power value 312 and less than THA; if the status flag is 1, the threshold value is set to the same level as THA. Hereinafter, in the embodiment, the threshold value determined at the transition from state S2 to S3 will be represented as THB and will be set to a level of 47 dBSPL (see FIG. 7). THB is a threshold value for determining a state in which the main body 100 is completely attached to the ear canal of the ear 500 (FIG. 5(*c*)). When this state is entered, the sound collection unit 101 does not collect the sound output by the sound output unit 106 and thus particularly the power value in the frequency band from 2 kHz to 2.25 kHz lessens. Thus, if THB is set in a direction in which it becomes large in a range larger than the initial power value 312 and less than THA, the effect of the reflection sound 502 becomes gradually small in the process in which a part of the main body 100 enters the ear canal of the ear 500 and then the main body 100 is completely attached. Thus, a possibility of erroneous determination of attachment becomes high. On the other hand, if THB is set in a direction in which it becomes small, the probability of erroneous determination lessens. However, if the main body 100 cannot completely be attached to the ear canal of the ear 500 depending on the attaching skill level of the user, the effect of the reflection sound 502 remains and thus a possibility that a transition from state S2 to state S3 will not be made becomes high.

Thus, from a tradeoff between the merit and the demerit when THB is changed, it is desirable that THB should become comparatively small within the range in which THB can be set. The value of THB set in state S2 can be adjusted to the most suitable value to the user from the fitting device, etc.

At this time, the threshold determination unit 303 outputs THB as the power threshold value 315.

[S3: State Just Before Attachment]

The power determination unit 304 makes a comparison between the power threshold value 315 where THB is output and the power value in the frequency band from 2 kHz to 2.25 kHz for each frame, and outputs the threshold value comparison signal 316. Consequently, when the state is S3, if the threshold value comparison signal 316 is low, the attaching state management unit 307 continues the state of S3 and when the threshold value comparison signal 316 goes high, a transition to state S4 is made.

[S4: Stable Wait State after Completion of Attachment]

When the state in the attaching state management unit 307 makes a transition from S3 to S4, the power continuation count unit 305 starts to count. That is, the attaching state signal 314 from the attaching state management unit 307 becomes 4 and the threshold value comparison signal 316 from the power determination unit 304 changes from low to high and thus the power continuation count unit 305 starts to count at 0. This counter value 317 is input to the continuation time determination unit 306. When the attaching state signal 314 is 0, 1, 2, or 3, the power continuation count unit 305 sets the counter value 317 to 0 and outputs it. The continuation time determination unit 306 makes a comparison between the counter value 317 and the attaching stable wait time described above. When the counter value 317 becomes equal to or greater than the attaching stable wait time, the switch trigger signal 318 changes low to high. The switch trigger signal 318 is input to the switch signal generation unit 308 and the attaching state management unit 307. When the switch trigger signal 318 changes from low to high, the attaching state management unit 307 makes a transition from state S4 to S5.

When the state is S4, when the threshold value comparison signal 316 changes from high to low, namely, the power value in the frequency band from 2 kHz to 2.25 kHz becomes larger than the power threshold value 315, the attaching state management unit 307 makes a transition from state S4 to state S3. That is, after the user once attaches the hearing aid to an ear, the user again attaches the hearing aid from the beginning before a lapse of the attaching stable wait time, the state is restored to the state just before attachment.

[S5: Hearing Aid Processing Operation State]

When the switch trigger signal 318 changes from low to high, the switch signal generation unit 308 changes the switch signal 115 from high to low and outputs the signal to the selection unit 105. The selection unit 105 selects the analog hearing aid signal 113 output by the hearing aid processing unit 102, and the usual hearing aid operation is started.

Thus, according to the embodiment, the sound collection unit 101 and the sound output unit 106 are included and the main body 100 of the shape attachable to an ear contains the hearing aid processing unit 102 for performing hearing aid processing for the surrounding sound collected by the sound collection unit 101, the attaching determination unit 104 for determining whether or not the main body 100 is attached to an ear based on the surrounding sound, the selection unit 105 for selecting either the sound subjected to the hearing aid processing by the hearing aid processing unit 102 or the sound generated by the specific sound generation unit 103 based on the determination result of the attaching determination unit 104 and outputting the selected sound to the sound output unit 106, so that the sound subjected to the hearing aid processing or the sound generated in the hearing aid can be selected and output to the sound output unit 106. Thus, the sound generated in the hearing aid can be selected and output to the sound output unit 106 until it is determined that the hearing aid is attached based on the sound generated in the hearing aid. Thus, the sound subjected to the hearing aid processing is not output before the user attaches the main body of the hearing aid, and consequently it is possible to prevent occurrence of acoustic feedback caused as the sound subjected to the hearing aid processing goes around at the attaching time of the hearing aid and is possible to enhance the user comfort.

The specific sound generation unit 103 not only may generate a sound of a single frequency, but also may output a guidance voice in an audible band together. The guidance voice is previously matched with the hearing aid characteristic of the hearing aid user. For example, a voice at frequency in the audible band such that "hearing aid attachment checking" is output from the sound output unit 106. In addition to the guidance voice, music data may be output. The sound generated by the specific sound generation unit 103 is an audible band and for the hearing aid user, when the state is a silent state in which no sound is output from the sound output unit 106, a state in which the user cannot distinguish between forgetting to turn on the power of the hearing aid and attaching determination can be circumvented. This means that the hearing aid user can understand that the hearing aid is started and can wait for attaching determination to complete.

The specific sound generation unit 103 may output an intermittent sound repeating on and off in an arbitrary pattern rather than a continuous sound. For example, in the embodiment, a pattern wherein after a sound of a single frequency is output for a 250-frame period (250×2 milliseconds=500 milliseconds), the state becomes a silent state for a 250-frame period may be output and the attaching determination unit 104 may determine an attaching state using the power value group 112 for a time period over which the sound of a single frequency is output from the specific sound generation unit 103. Since the on and off timings of the sound of a single frequency are controlled in the specific sound generation unit 103, timing control as to whether or not the power value group 112 input to the attaching determination unit 104 is effectively used can be realized easily.

The method can be applied not only to the intermittent sound repeating on and off in an arbitrary patter, but also output of a voice and music. For example, to output music, storage means of memory, etc., is provided in the specific sound generation unit 103 and music data is previously stored by the fitting device, etc. At this time, information as to what frequency is to be output at what timing in a time axis direction is also stored. Although not shown in the figure, if read/write access is made possible from each block in the hearing aid processing unit to the storage means of memory, etc., provided in the specific sound generation unit 103, the frequency component contained in the music data, for example, until a transition to S1 is made from termination of initialization in state S0, whereby information as to what frequency is to be output at what timing in the time axis direction can also be obtained.

To output music, sequentially changing frequency rather than a single frequency is output; the specific sound generation unit 103 can recognize what frequency is output, etc., by the method. Therefore, timing control for effectively using the power value group 112 input to the attaching determination unit 104 can be realized easily in a similar manner to that described above.

To output a voice from the specific sound generation unit 103, attachment determination is also possible by a similar method to that of outputting music described above.

The specific sound generation unit 103 may generate at least one of voice and music signals indicating that the main body 100 is attached to an ear at the same time as the signal of the sound of a single frequency. Here, outputting of the voice and music signals by the specific sound generation unit 103 is contained in generation of them.

To eliminate a muffled sound sense, if the hearing aid is of open fitting type wherein the main body 100 has a vent with a large diameter, etc., a passage where a sound goes around toward the sound collection unit 101 from the sound output unit 106 remains eve in an attaching state and an acoustic loop is formed. Accordingly, in an attaching determination unit 104, a predetermined power value is detected in a frequency band of a sound generated by the specific sound generation unit 103. However, although depending on the opening size of the vent, etc., the power value becomes small as compared with a non-attached state and the level of the power value can be previously grasped. Then, the value resulting from adding the power value remaining in open fitting to the power threshold value 315 found by the threshold value determination unit 303 of the attaching determination unit 104 can be used as a threshold value. Thus, if the hearing aid is of the open fitting type, the method of the invention effectively acts by changing the threshold value.

In the description of the embodiment, the main body 100 is the in-the-ear type, but similar comments apply to all hearing aids wherein acoustic feedback is caused by an acoustic loop; the invention can also be applied to a behind-the-ear hearing aid, etc., for example.

In the description of the embodiment, the sound generated by the specific sound generation unit 103 is 2 kHz, but may be set to a high frequency close to the upper limit of the audible band of a human being. Further, the sampling frequency is raised, whereby the sound can also be set to a frequency exceeding the upper limit of the audible band of a human being. In so doing, if the sound generated by the specific sound generation unit 103 is output to the outside of the main body 100, the hearing aid user or the surround persons are hard to hear and if the volume of an output sound is made large, an unwell feeling is not given. Further, a sound of a frequency higher than the audible band exists stationarily in a special environment and usually does not much occur. Thus, if attachment determination of the hearing aid is executed based on the sound in the band, erroneous determination caused by the surrounding sound is hard to occur.

Embodiment 2

Figure 8:
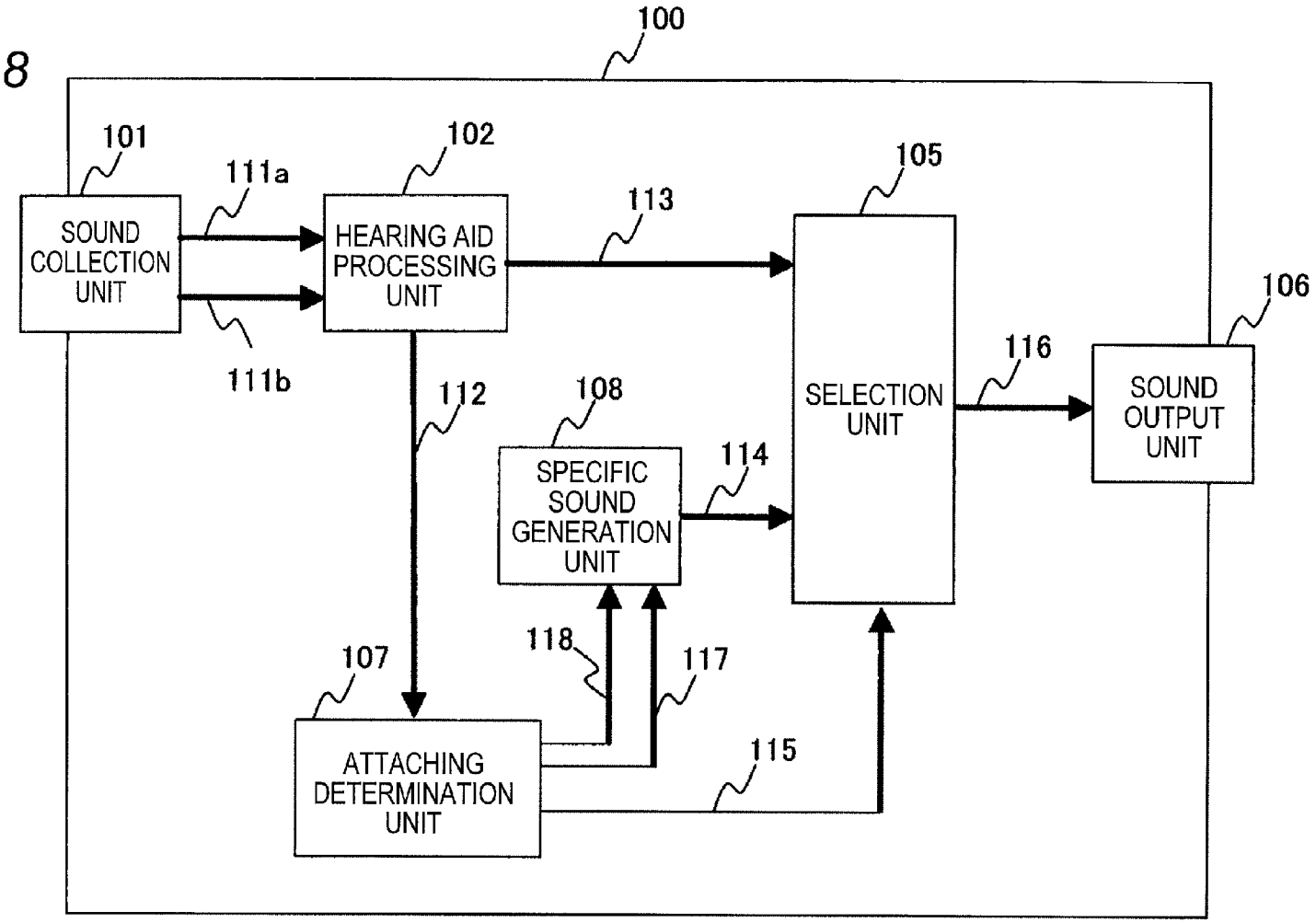
FIG. 8 is a block diagram to show a block configuration of a hearing aid in Embodiment 2 of the invention.

FIG. 8 is a block diagram to show the block configuration of a hearing aid in Embodiment 2 of the invention. An attaching determination unit 107 and a specific sound generation unit 108 replace the attaching determination unit 104 and the specific sound generation unit 103 in FIG. 1 respectively. Components identical with those of Embodiment 1 except the attaching determination unit 107 or the specific sound generation unit 108 are denoted by the same reference numerals and will not be discussed again in detail.

Embodiment 2 differs from Embodiment 1 largely in that first the attaching determination unit 107 creates a switch signal 115, a specific sound output increment amount signal 117, and a specific sound generation permission signal 118 using a power value group 112 output from a hearing aid processing unit 102, outputs the switch signal 115 to a selection unit 105, and outputs the specific sound output increment amount signal 117 and the specific sound generation permission signal 118 to the specific sound generation unit 108 and that the specific sound generation unit 108 outputs a specific sound signal 114 whose output level is determined based on the specific sound output increment amount signal 117 to the selection unit 105.

Figure 9:
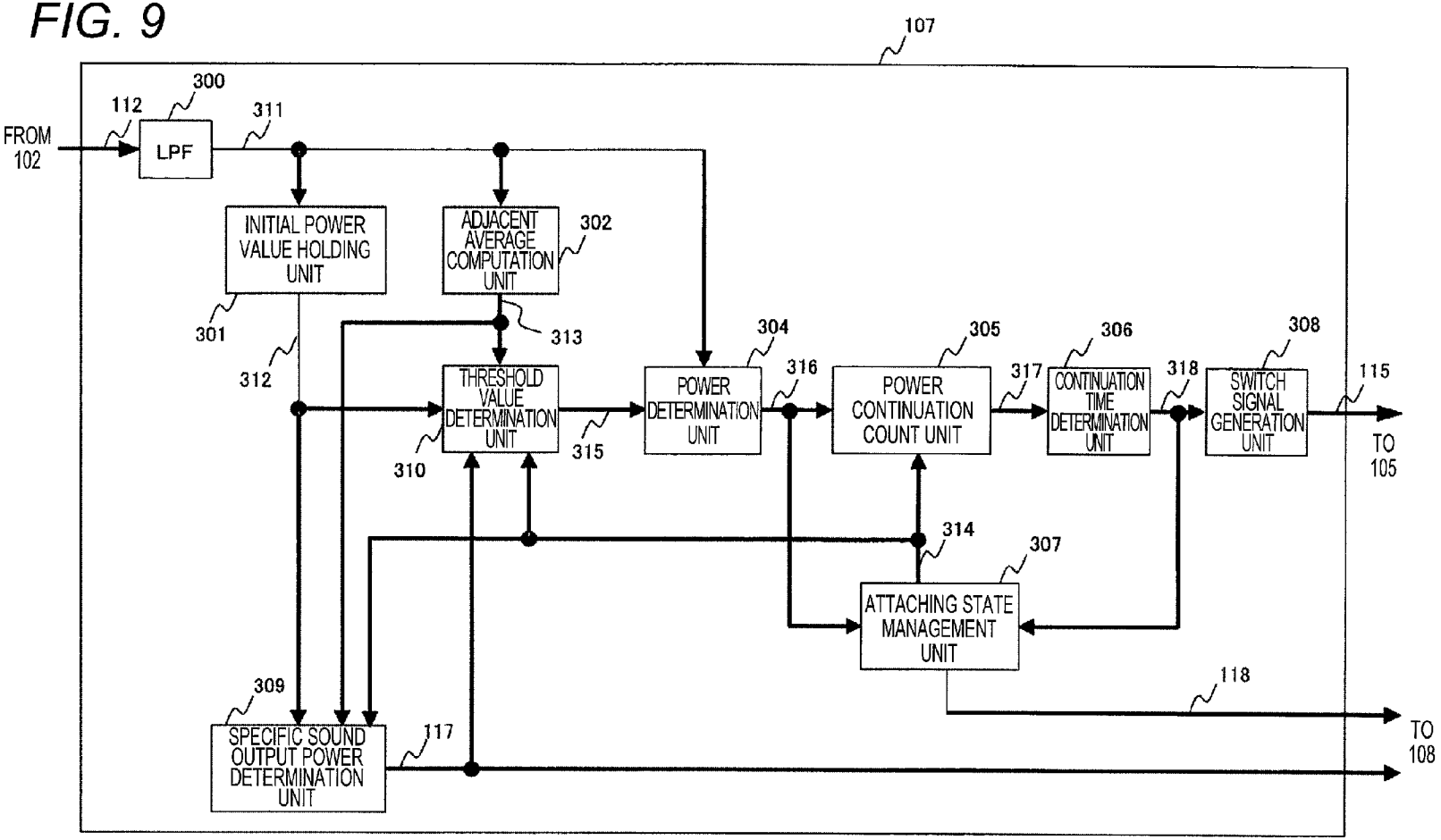
FIG. 9 is a block diagram of an attaching determination unit in Embodiment 2 of the invention.

FIG. 9 is a block diagram of the attaching determination unit 107 in Embodiment 2 of the invention. Components identical with those shown in FIG. 3 are denoted by the same reference numerals in FIG. 9 and will not be discussed again. The attaching determination unit 107 differs from the attaching determination unit 104 shown in FIG. 3 in that a specific sound output power determination 309 is added and a determination method of a threshold value in a threshold value determination unit 310 is changed.

The specific sound output power determination 309 creates a specific sound output increment amount signal 117 to determine the sound pressure level of a specific sound from an initial power value 312 and an adjacent power average value 313, and outputs the signal to the threshold value determination unit 310 and the specific sound generation unit 108. The threshold value determination unit 310 determines a threshold value output as a power threshold value 315 using the specific sound output increment amount signal 117.

Subsequently, the detailed operation of the attaching determination unit 107 will be discussed with FIGS. 4, 5, 8, and 9. From here, description is given along the transition of states S0 to S5 in the attaching state management unit 307. In the embodiment, the case where when the user attaches a main body 100, the user exists in an environment in which the surrounding sound is comparatively large will be discussed.

[S0: Initial State]

When the power of the main body 100 is turned on, the attaching state management unit 307 becomes state 0 shown in FIG. 4. At this time, the blocks of the attaching determination unit 107 are also initialized. For example, means (not shown) for holding a status flag indicating either 0 or 1 is provided in the threshold value determination unit 310 and in state S0, the flag is set to 0. That is, when an attaching state signal 314 is 0, initialization is executed. When the whole circuit of the hearing aid starts up and becomes a stationary state, the attaching state management unit 307 makes a transition to state S1. The transition from state 0 to state 1 is the same as that shown in Embodiment 1.

If the sound pressure level of a specific sound is too small, the sound becomes hard to be distinguished from the surrounding sound and the detection accuracy is degraded. Thus, in the embodiment, the level is preset to a sound pressure of 62 dBSPL of the magnitude of an ordinary conversation sound of a human being in the initialization performed when the attaching state signal 314 is 0. In the description to follow, the sound pressure level of 62 dBSPL set here is the initial sound pressure level. The initial sound pressure level is retained in storage means of a register, memory, or the like (not shown) in the main body 100 of the hearing aid and can be read from the blocks making up the attaching determination unit 107 and the specific sound generation unit 108.

[S1: Surrounding Sound Determination State]

In the attaching state management unit 307, when a transition to S1 is made, the attaching state signal 314 is set to 1. Then, the specific sound output power determination 309 determines the specific sound output increment amount signal 117 from the initial power value 312 and the adjacent power average value 313. The magnitude resulting from adding the specific sound output increment amount signal 117 and the initial sound pressure level is the final sound pressure level of the specific sound.

When the adjacent power average value 313 is smaller than the initial power value 312, the effect of the surrounding sound is small and thus the specific sound output increment amount signal 117 is set to 0. At this time, the sound pressure level of the specific sound becomes the initial sound pressure level 62 dBSPL+0 dBSPL=62 dBSPL. In the threshold value determination unit 310, a comparison is also made between the adjacent power average value 313 and the initial power value 312. Since the adjacent power average value 313 is smaller than the initial power value 312, 0 is held in the internal status flag.

Next, the case where the adjacent power average value 313 is equal to or greater than the initial power value 312 will be discussed. For example, assuming that the initial power value 312 is 45 dBSPL and the adjacent power average value 313 is 50 dBSPL, the specific sound output power determination 309 sets a level resulting from adding 20 dBSPL to the adjacent power average value 313 (which will be hereinafter called target level). This means that the target level becomes 50 dBSPL+20 dBSPL=70 dBSPL.

Subsequently, the specific sound output power determination 309 outputs the difference between the target level and the initial sound pressure level (70 dBSPL−62 dBSPL=8 dBSPL) as the specific sound output increment amount signal 117.

In the threshold value determination unit 310, a comparison is also made between the adjacent power average value 313 and the initial power value 312. If the adjacent power average value 313 is larger than the initial power value 312, the internal status flag is changed to 1.

The threshold value determination unit 310 determines a threshold value THC from the initial power value 312, the adjacent power average value 313, and the specific sound output increment amount signal 117.

THC is the threshold value for determining a state in which the main body 100 is brought close to an ear 500 and the volume of the sound collected by the sound collection unit 101 becomes large because of the effect of reflection sound 502 (FIG. 5(*b*)). Thus, if THC is set in a direction in which it becomes small in the range in which THC is larger than the adjacent power average value 313 and is smaller than the sound pressure level of the specific sound, the effect of the surrounding sound is easily received and thus the occurrence probability of erroneous determination (although the main body 100 is not brought close to the ear 500, it is determined that the main body 100 is brought close to the ear 500) becomes high. On the other hand, if THC is set in a direction in which it becomes large, the effect of the surrounding sound becomes hard to receive. However, the magnitude of the reflection sound 502 varies depending on the shape of a pinna whose personal equation is large and the positional relationship between the main body 100 of the hearing aid and the ear 500 at the attaching time and thus a possibility that it will become impossible to determine that the main body 100 is brought close to the ear 500 occurs. Thus, from a tradeoff between the merit and the demerit when THC is changed, it is desirable that THC should become comparatively large within the range in which THC can be set. In the embodiment, if the status flag is 0, the threshold value is set to 57 dBSPL of a value larger than the initial power value 312; if the status flag is 1, the threshold value is set to 65 dBSPL resulting from adding 8 dBSPL indicated by the specific sound output increment amount signal 117 to 57 dBSPL as an explanatory example.

The value of THC set in state S1 can be adjusted to the most suitable value to the user from the fitting device, etc.

After the threshold value THC is set by the method, the attaching state management unit 307 makes a transition from state S1 to state S2.

[S2: Attaching Start State]

The power determination unit 304 makes a comparison between the power threshold value 315 where THC is output and the power value in the frequency band from 2 kHz to 2.25 kHz for each frame, and outputs a threshold value comparison signal 316. Consequently, if the threshold value comparison signal 316 is high, the attaching state management unit 307 continues the state of S2 and when the threshold value comparison signal 316 goes low, a transition to state S3 is made.

The threshold determination unit 310 changes the power threshold value 315 at the timing at which a transition to state S3 is made.

Specifically, when the attaching state signal 314 changes from 2 to 3, if the status flag in the threshold determination unit 310 is 0, the threshold value is set to 47 dBSPL larger than the initial power value 312 and less than THC; if the status flag is 1, the threshold value is set to 55 dBSPL resulting from adding 8 dBSPL indicated by the specific sound output increment amount signal 117 to 47 dBSPL. Hereinafter, in the embodiment, the threshold value determined at the transition from state S2 to S3 will be represented as THD and will be set to a level of 55 dBSPL.

THD is a threshold value for determining a state in which the main body 100 is completely attached to the ear canal of the ear 500 (FIG. 5(*c*)). When this state is entered, the sound collection unit 101 does not collect the sound output by a sound output unit 106 and thus particularly the power value in the frequency band from 2 kHz to 2.25 kHz lessens. Thus, if THD is set in a direction in which it becomes large in a range larger than the adjacent power average value 313 and less than THC, the effect of the reflection sound 502 becomes gradually small in the process in which a part of the main body 100 enters the ear canal of the year 500 and then the main body 100 is completely attached. Thus, a possibility of erroneous determination of attachment becomes high. On the other hand, if THB is set in a direction in which it becomes small, the probability of erroneous determination lessens. However, if the main body 100 cannot completely be attached to the ear canal the year 500 depending on the attaching skill level of the user, the effect of the reflection sound 502 remains and thus a possibility that a transition from state S2 to state S3 will not be made becomes high.

Thus, from a tradeoff between the merit and the demerit when THD is changed, it is desirable that THD should become comparatively small within the range in which THD can be set. The value of THD set in state S2 can be adjusted to the most suitable value to the user from the fitting device, etc.

[S3: State Just Before Attachment]

The power determination unit 304 makes a comparison between the power threshold value 315 where THD is output and the power value in the frequency band from 2 kHz to 2.25 kHz for each frame, and outputs the threshold value comparison signal 316. Consequently, when the state is S3, if the threshold value comparison signal 316 is low, the attaching state management unit 307 continues the state of S3 and when the threshold value comparison signal 316 goes high, a transition to state S4 is made.

[S4: Stable Wait State after Completion of Attachment]

When the state in the attaching state management unit 307 makes a transition from S3 to S4, the power continuation count unit 305 starts to count. The operation of each block in the state S4 is the same as that shown in Embodiment 1. When the switch trigger signal 318 output by the continuation time determination unit 306 changes from low to high, the attaching state management unit 307 makes a transition from state S4 to S5.

[S5: Hearing Aid Processing Operation State]

When the switch trigger signal 318 changes from low to high, the switch signal generation unit 308 changes the switch signal 115 from high to low and outputs the signal to the selection unit 105. The selection unit 105 selects the analog hearing aid signal 113 output by the hearing aid processing unit 102, and the usual hearing aid operation is started.

Thus, according to the embodiment, in addition to the configuration shown in Embodiment 1, the sound pressure level of the sound generated in the hearing aid is changed in response to the level of the sound surrounding the hearing aid. Thus, the sound subjected to hearing aid processing before the user attaches the main body of the hearing aid is not output in a situation in which a comparatively large sound occurs in the surrounding of the hearing aid and consequently, it is possible to prevent occurrence of acoustic feedback caused as the sound subjected to the hearing aid processing goes around at the attaching time of the hearing aid and is possible to enhance the user comfort.

In the embodiment, the level resulting from adding 20 dBSPL to the adjacent power average value 313 is adopted as the target level; it is also possible to prevent the target level from increasing a given value or more in an environment in which the surrounding sound is a given level or more. When the user attempts to attach the main body 100 of the hearing aid in an environment in which the surrounding sound is very large, if the sound pressure level of the specific sound becomes too large in response to the surrounding sound, the user feels uncomfortable. Specifically, the maximum power level is set at the initialization time in state S0 using a register (not shown) provided in the specific sound output power determination 309 and the specific sound output power determination 309 always makes a comparison between the target level and the maximum power level. If the target level becomes larger than the maximum power level, the target level can be replaced with the maximum power level. As specific numeric values, if the maximum power level is set to 75 dBSPL, the target level when the adjacent power average value 313 is 55 dBSPL becomes the sound pressure resulting from adding 20 dBSPL to the adjacent power average value 313 and the target level when the adjacent power average value 313 is larger than 55 dBSPL becomes 75 dBSPL equal to the maximum power level.

In the description of the embodiment, the case where the user attaches the main body 100 in an environment in which the surrounding sound is comparatively large is taken as an example and thus THC is set to 65 dBSPL smaller than 70 dBSPL of the volume pressure level of the specific sound by 5 dB. Setting of the value of THC set when the adjacent power average value 313 is greater than the initial power value 312 in state S1 can be updated when fitting is performed in addition to register setting by hardware forming the main body 100 of the hearing aid and software control in the main body 100 of the hearing aid or a CPU, etc., not shown.

Like setting of the threshold value THC, setting of the target value and the maximum power level can be updated by hardware or software setting or when fitting is performed.

The specific sound generation unit 108 not only may generate a sound of a single frequency, but also may output a guidance voice in an audible band together. The guidance voice is previously matched with the hearing aid characteristic of the hearing aid user. For example, a voice at frequency in the audible band such that "hearing aid attachment checking" is output from the sound output unit 106. In addition to the guidance voice, music data may be output. The sound generated by the specific sound generation unit 108 is an audible band and for the hearing aid user, when the state is a silent state in which no sound is output from the sound output unit 106, a state in which the user cannot distinguish between forgetting to turn on the power of the hearing aid and attaching determination can be circumvented. This means that the hearing aid user can understand that the hearing aid is started and can wait for attaching determination to complete.

The specific sound generation unit 108 may output an intermittent sound repeating on and off in an arbitrary pattern rather than a continuous sound. For example, in the embodiment, a pattern wherein after a sound of a single frequency is output for a 250-frame period (250×2 milliseconds=500 milliseconds), the state becomes a silent state for a 250-frame period may be output and the attaching determination unit 107 may determine an attaching state using the power value group 112 for a time period over which the sound of a single frequency is output from the specific sound generation unit 108. Since the on and off timings of the sound of a single frequency are controlled in the specific sound generation unit 103, timing control as to whether or not the power value group 112 input to the attaching determination unit 107 is effectively used can be realized easily.

The method can be applied not only to the intermittent sound repeating on and off in an arbitrary patter, but also output of a voice and music. For example, to output music, storage means of memory, etc., is provided in the specific sound generation unit 108 and music data is previously stored by the fitting device, etc. At this time, information as to what frequency is to be output at what timing in a time axis direction is also stored. Although not shown in the figure, if read/write access is made possible from each block in the hearing aid processing unit to the storage means of memory, etc., provided in the specific sound generation unit 108, the frequency component contained in the music data, for example, until a transition to S1 is made from termination of initialization in state S0, whereby information as to what frequency is to be output at what timing in the time axis direction can also be obtained.

To output music, sequentially changing frequency rather than a single frequency is output; the specific sound generation unit 108 can recognize what frequency is output, etc., by the method. Therefore, timing control for effectively using the power value group 112 input to the attaching determination unit 107 can be realized easily in a similar manner to that described above.

To output a voice from the specific sound generation unit 108, attaching determination is also possible by a similar method to that of outputting music described above.

To eliminate a muffled sound sense, if the hearing aid is of open fitting type wherein the main body 100 has a vent with a large diameter, etc., a passage where a sound goes around toward the sound collection unit 101 from the sound output unit 106 remains eve in an attaching state and an acoustic loop is formed. Accordingly, in an attaching determination unit 107, a predetermined power value is detected in a frequency band of a sound generated by the specific sound generation unit 108. However, although depending on the opening size of the vent, etc., the power value becomes small as compared with a non-attached state and the level of the power value can be previously grasped. Then, the value resulting from adding the power value remaining in open fitting to the power threshold value 315 found by the threshold value determination unit 310 of the attaching determination unit 107 can be used as a threshold value. Thus, if the hearing aid is of the open fitting type, the method of the invention effectively acts by changing the threshold value.

In the description of the embodiment, the main body 100 is the in-the-ear type, but similar comments apply to all hearing aids wherein acoustic feedback is caused by an acoustic loop; the invention can also be applied to a behind-the-ear hearing aid, etc., for example.

In the description of the embodiment, the sound generated by the specific sound generation unit 108 is 2 kHz, but may be set to a high frequency close to the upper limit of the audible band of a human being. Further, the sampling frequency is raised, whereby the sound can also be set to a frequency exceeding the upper limit of the audible band of a human being. In so doing, if the sound generated by the specific sound generation unit 108 is output to the outside of the main body 100, the hearing aid user or the surround persons are hard to hear and if the volume of an output sound is made large, an unwell feeling is not given. Further, a sound of a frequency higher than the audible band exists stationarily in a special environment and usually does not much occur. Thus, if attaching determination of the hearing aid is executed based on the sound in the band, erroneous determination caused by the surrounding sound is hard to occur.

The numeric values concerning the frequency, the magnitude of sound (power value, sound pressure level), the frame period, the threshold value, and the like described in the embodiment are examples and the invention is not limited to them.

While the invention has been described in detail with reference to the specific embodiments, it will be apparent to those skilled in the art that various changes and modifications may be made without departing from the spirit and the scope of the invention.

This application is based on Japanese Patent Application No. 2008-303979 filed on Nov. 28, 2008, which is incorporated herein by reference.

INDUSTRIAL APPLICABILITY

As described above, the hearing aid according to the embodiment can suppress output of the sound amplified by hearing aid processing until the user attaches the main body of the hearing aid to an ear, so that it is useful as a hearing sense aid device, etc., in which acoustic feedback uncomfortable for the user does not occur.

DESCRIPTION OF REFERENCE SIGNS

100 Main body
101 Sound collection unit
102 Hearing aid processing unit
103, 108 Specific sound generation unit
104, 107 Attaching determination unit
105 Selection unit
106 Sound output unit
111*a*, 111*b* Analog input signal
112 Power value group
113 Analog hearing aid signal
114 Specific sound signal
115 Switch signal
116 Selection output signal
117 Specific sound output increment amount signal
118 Specific sound generation permission signal
201 A/D conversion unit
202 Directivity synthesis unit
203 Frequency analysis unit
204 Power calculation unit
205 Gain control unit
206 Gain adjustment unit
207 Frequency synthesis unit
208 D/A conversion unit
211*a*, 211*b* Digital input signal
212 Synthesized signal
213 Frequency signal group
214 Gain control signal group
215 Already adjusted frequency signal group
216 Digital hearing aid signal
300 LPF
301 Initial power value holding unit
302 Adjacent average computation unit
303, 310 Threshold value determination unit

304 Power determination unit
305 Power continuation count unit
306 Continuation time determination unit
307 Attaching state management unit
308 Switch signal generation unit
309 Specific sound output power determination unit
311 Smooth power value group
312 Initial power value
313 Adjacent power average value
314 Attaching state signal
315 Power threshold value
316 Threshold value comparison signal
317 Counter value
318 Switch trigger signal
500 Ear of hearing aid user
501 Sound to sound collection unit 101
502 Sound reflected on ear 500 and going around in direction of sound collection unit 101

The invention claimed is:

1. A hearing aid comprising:

a sound collection unit configured to collect a surrounding sound;

a sound output unit configured to output a sound; and a main body having a shape attachable to an ear, wherein the main body comprises:

a hearing aid processing unit configured to perform hearing aid processing for the surrounding sound collected by the sound collection unit;

an attaching determination unit configured to determine whether the main body is attached to the ear based on the surrounding sound;

a specific sound generation unit configured to generate a predetermined signal; and a selection unit configured to select one of a sound subjected to the hearing aid processing by the hearing aid processing unit and a sound generated by the specific sound generation unit based on a determination result of the attaching determination unit, and to output the selected sound to the sound output unit, wherein the selection unit is configured to:

select the sound generated by the specific sound generation unit, and output the sound to the sound output unit, until the attaching determination unit determines that the main body is attached to the ear since power of the main body has been turned on; and select the sound subjected to the hearing aid processing by the hearing aid processing unit, and output the selected sound to said sound output unit, after it is determined that the main body is attached to the ear.

2. The hearing aid according to claim 1, wherein the predetermined signal comprises at least one of a sound of a single frequency, a voice, and music.

3. The hearing aid according to claim 1, wherein the specific sound generation unit generates at least one of a signal of a voice and music indicating that the main body is attached to the ear, together with a signal of a sound of a single frequency.

4. The hearing aid according to claim 1, wherein the predetermined signal is a frequency signal in an audible band.

5. The hearing aid according to claim 1, wherein the predetermined signal is a frequency signal in an inaudible band.

6. The hearing aid according to claim 1, wherein the attaching determination unit determines that the main body is attached to the ear when a signal level of a signal contained in the surrounding sound collected by the sound collection unit and having a same frequency band as the signal generated by the specific sound generation unit becomes larger than a first threshold value and then continues to be smaller than a second threshold value for a predetermined time period.

7. The hearing aid according to claim 1, wherein the attaching determination unit sets a level of the sound output by the specific sound generation unit larger than a level of the surrounding sound collected by the sound collection unit, and informs the specific sound generation unit of information of a difference between the level of the sound output by the specific sound generation unit and an initial sound pressure level.

* * * * *